US007159637B2

(12) United States Patent
Snyder et al.

(10) Patent No.: US 7,159,637 B2
(45) Date of Patent: Jan. 9, 2007

(54) IMPACTABLE BOTTOM CURTAIN FOR A ROLLING STEEL DOOR

(75) Inventors: Ronald P. Snyder, Peosta, IA (US); Linda Kasper, Sussex, WI (US); Jason D. Miller, Sherrill, IA (US); Donald P. Grant, Dubuque, IA (US); Paul Maly, Mequon, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 10/803,150

(22) Filed: Mar. 17, 2004

(65) Prior Publication Data

US 2005/0205218 A1 Sep. 22, 2005

(51) Int. Cl.
*E06B 9/15* (2006.01)

(52) U.S. Cl. ..... 160/121.1; 160/133; 160/405

(58) Field of Classification Search ..... 160/133, 160/264, 201, 405, 121.1, 270, 271, 272, 160/273.1, 349.1
See application file for complete search history.

(56) References Cited

U.S. PATENT DOCUMENTS

| | | | | | |
|---|---|---|---|---|---|
| 2,388,297 | A | | 11/1945 | Slaughter | |
| 2,404,257 | A | * | 7/1946 | Harry | 160/133 |
| 2,803,297 | A | | 8/1957 | Wenke | |
| 3,292,685 | A | * | 12/1966 | Morton | 160/26 |
| 3,331,425 | A | * | 7/1967 | Groves et al. | 160/126 |
| 3,583,465 | A | * | 6/1971 | Youngs et al. | 160/264 |
| 4,232,725 | A | * | 11/1980 | Gidge | 160/332 |
| 4,478,268 | A | * | 10/1984 | Palmer | 160/310 |
| 4,601,320 | A | * | 7/1986 | Taylor | 160/271 |
| 4,800,946 | A | * | 1/1989 | Rosenoy | 160/264 |
| 5,025,847 | A | | 6/1991 | Mueller | |
| 5,056,579 | A | | 10/1991 | Kraeutler | |
| 5,141,043 | A | | 8/1992 | Kraeutler | |
| 5,141,044 | A | | 8/1992 | Hying et al. | |
| 5,207,256 | A | | 5/1993 | Kraeutler | |
| 5,307,859 | A | | 5/1994 | Kraeutler | |
| 5,392,836 | A | | 2/1995 | West et al. | |
| 5,450,890 | A | * | 9/1995 | Pinkalla et al. | 160/121.1 |
| 5,474,118 | A | | 12/1995 | Hoffman | |
| 5,477,902 | A | | 12/1995 | Kraeutler | |

(Continued)

OTHER PUBLICATIONS

Cornell Iron Works, "Introducing the Bull Fighter: Repeated Door Damage is a Lot of Bull," 4 pages, dated Jun. 12, 1998.

*Primary Examiner*—David Purol
(74) *Attorney, Agent, or Firm*—Hanley, Flight & Zimmerman, LLC

(57) ABSTRACT

To avoid repeated damage to a lower section of a metal roll-up door, the lower section is replaced by a more impactable curtain assembly. The curtain assembly is so readily scalable, horizontally and vertically, that much of it can be manufactured and field assembled right at the installation site. The curtain assembly may comprise one or more strips of fabric that are cut from a roll of a certain width. The length of the fabric strips corresponds to the width of the doorway, and the number of strips is based on the vertical span of the door section that is being replaced. Windbars can be attached where adjacent strips connect to each other. A weighted, semi-rigid bottom bar reinforces the lower edge of the finished roll-up curtain. Under impact, the bottom bar has sufficient flexibility to allow the curtain to resiliently break away from within the door's vertical guide tracks.

5 Claims, 3 Drawing Sheets

U.S. PATENT DOCUMENTS 5,848,631 A 12/1998 DeGiovanni et al.
5,964,270 A * 10/1999 Kirkey et al. ..... 160/273.1
6,065,525 A 5/2000 Wells
6,070,640 A * 6/2000 Miyagawa et al. ..... 160/121.1
6,655,442 B1 * 12/2003 Snyder ..... 160/201
6,722,416 B1 * 4/2004 Varley et al. ..... 160/264

* cited by examiner

IMPACTABLE BOTTOM CURTAIN FOR A ROLLING STEEL DOOR

BACKGROUND OF THE INVENTION

1. Field of the Invention

The subject invention generally pertains to industrial rollup doors and more specifically to a flexible curtain that can replace a lower section of such a door.

2. Description of Related Art

Roll-up doors typically comprise a flexible roll-up panel or curtain that is wound about an overhead roller. Roll-up curtains can be made of pliable fabric or a series of pivotally interconnected, horizontal rigid slats made of metal or some other rigid material. To close the door, the roller pays out the curtain as two vertical tracks disposed along either side edge of the doorway guide the side edges of the curtain along a generally vertical plane across the doorway. The rotation of the roller is reversed to open the door. Typically, roll-up doors are either powered open and closed or are powered open and allowed to descend by gravity.

Fabric curtains are generally lightweight and pliable, which typically makes them faster operating and more impactable than metal roll-up curtains. In some applications, fabric curtains are reinforced with a series of relatively stiff horizontal stays or windbars, which help prevent the curtain from billowing due to air pressure differentials across opposite faces of the curtain.

Metal curtains, on the other hand, are usually heavier and slower, but their horizontal rigidity and strength make them particularly suitable for use on exterior roll-up doors where security and wind resistance is important.

Metal roll-up doors, unfortunately, are generally less impactable than fabric doors. A forklift, for instance, may accidentally strike a roll-up door and force its curtain out from within the door's vertical guide tracks. If the curtain is made of a pliable fabric, the curtain may be readily reinserted into the tracks and the door returned to normal operation without any permanent damage. If the door has a curtain comprised of rigid metal slats, however, an impact can permanently bend or damage several of the slats. It seems that the slats near the lower edge of the curtain are the ones that are most often damaged due to forklifts or other vehicles attempting to pass through the doorway when door is not completely open. Sometimes just a few of the lowermost slats are damaged, but much higher slats can also be affected.

In some cases, the lowermost slats of a metal door can be replaced by a product known as a MATADOOR curtain, which is made by Cornell Iron Works of Mountaintop PA. A Matadoor curtain is a breakaway pliable curtain section that can be attached to the lower edge of the remaining undamaged upper section of a metal curtain. Although such a product may be effective, it does have its limitations.

First, the bottom bar of such a curtain assembly has a riveted connector that can break away in response to an impact. After breaking away, the bottom bar apparently needs to be repaired by using a tool to rivet or otherwise reassembly the connector and the bottom bar back together Second, the width of doorways may vary widely, which raises the question of where to place the breakaway connector. If the connector belongs at the center of the doorway, the two bottom bar segments may both need to be custom cut to fit. Since the two bottom bar segments are not identical due to their beveled edges at the central connector, both right-hand and left-hand bar segments may need to be stocked for ensuring ready availability.

Third, although conceivably any size fabric sheet could be cut to match the opening left by the removed damaged slats, a final curtain assembly is not so readily made to just any size. A single roll of curtain material may have to be unreasonably large and cumbersome for it to be sufficiently large to cover any possible height and width.

Fourth, the height of this type of replacement curtain may vary depending on how many slats are being replaced. If the height becomes too great, the curtain may tend to billow for its failure to provide any means for installing windbars.

Fifth, a tall section of fabric curtain may be appreciably lighter than the metal slats it is replacing. Since a roll-up door's counterweight spring is presumably preloaded to match the metal curtain's original weight, the spring preload may be too great for a curtain whose weight has just been reduced due to the installation of a sizable fabric curtain section. Thus, replacing metal slats with such a curtain may involve having to adjust the preload of the door's counterweight spring.

Consequently, a need still remains for a quick and effective way of replacing the damaged bottom section of a metal roll-up door whose damaged section is of an indeterminate size.

SUMMARY OF THE INVENTION

In some embodiments, a metal roll-up door is provided with an impactable panel assembly that includes a flexible curtain.

In some embodiments, the impactable panel assembly includes a bottom bar that is sufficiently flexible to respond to an impact by resiliently bending out from within the door's vertical guide tracks.

In some embodiments, the impactable panel assembly comprises a plurality of flexible curtain segments that provide the panel assembly with a particular height.

In some embodiments, adjacent flexible curtain segments are connected by a windbar, which increases the curtain's resistance to air pressure differentials across opposite faces of the curtain assembly.

In some embodiments, adjacent flexible curtain segments overlap each other to provide a more weather resistant joint between them.

In some embodiments, the impactable panel assembly includes a bottom bar that comprises two bar segments that rigidly joined end-to-end.

In some embodiments, the impactable panel assembly includes a bottom bar that comprises two bar segments mounted side-by-side with a seal member clamped therebetween.

In some embodiments the bottom bar of an impactable panel assembly includes laterally protruding guide tabs that slide within the vertical guide tracks of a roll-up door.

In some embodiments, deadweights are added to a roll-up door to offset the weight that was lost when a lower section of the door's original panel was replaced by a lighter panel.

In some embodiments, the deadweights are spaced apart from each other to ensure that the bottom bar of the curtain maintains sufficient flexibility.

In some embodiments, various size curtain assemblies are produced by cutting a roll of fabric into strips of a certain length, wherein the length generally corresponds to the width of the doorway and the width of the strip (width of the roll) times the number of strips generally corresponds the vertical opening that the curtain assembly is to cover.

DESCRIPTION OF THE PREFERRED EMBODIMENT

Figure 1:
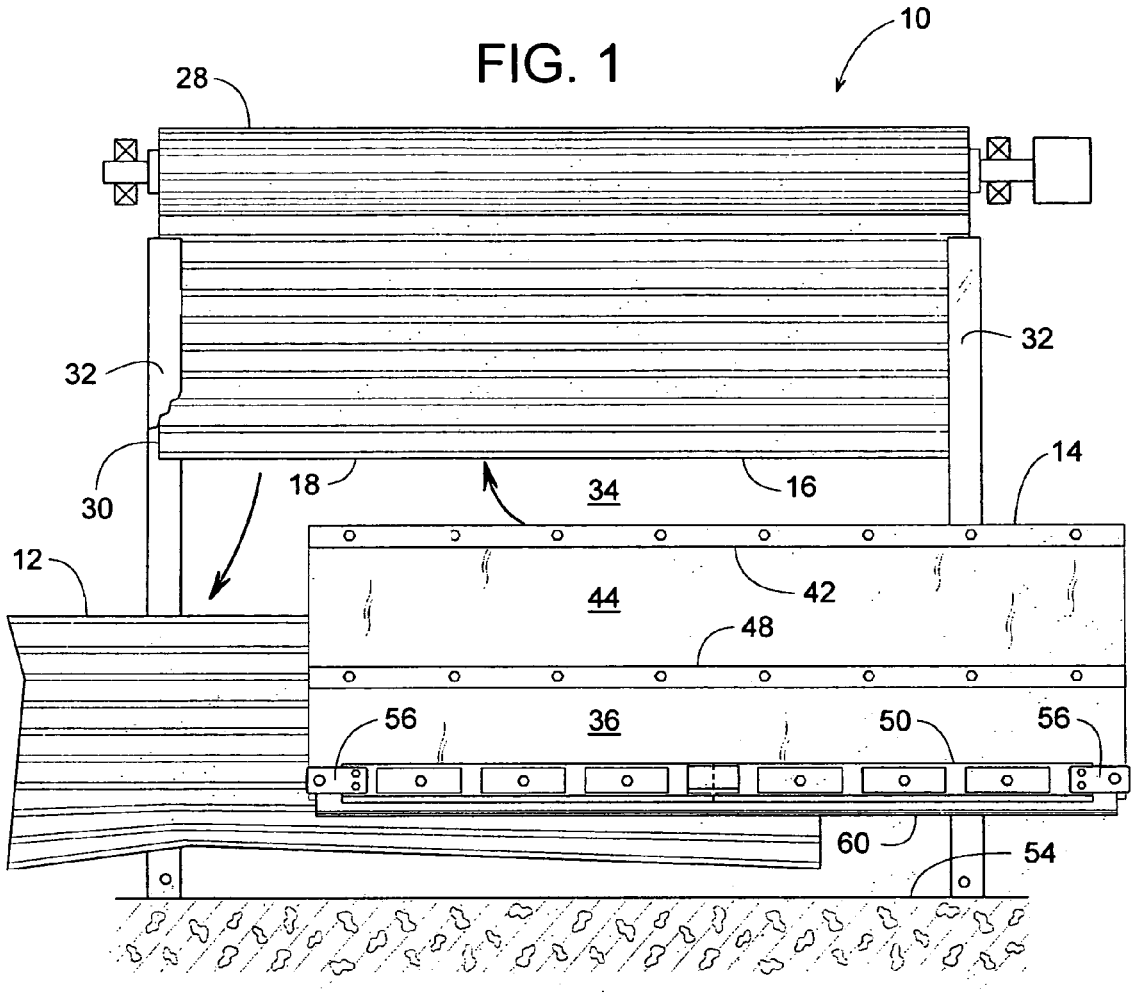
FIG. 1 is a front view of a metal roll-up door whose lower section is being replaced by a more impactable panel assembly.
Figure 2:
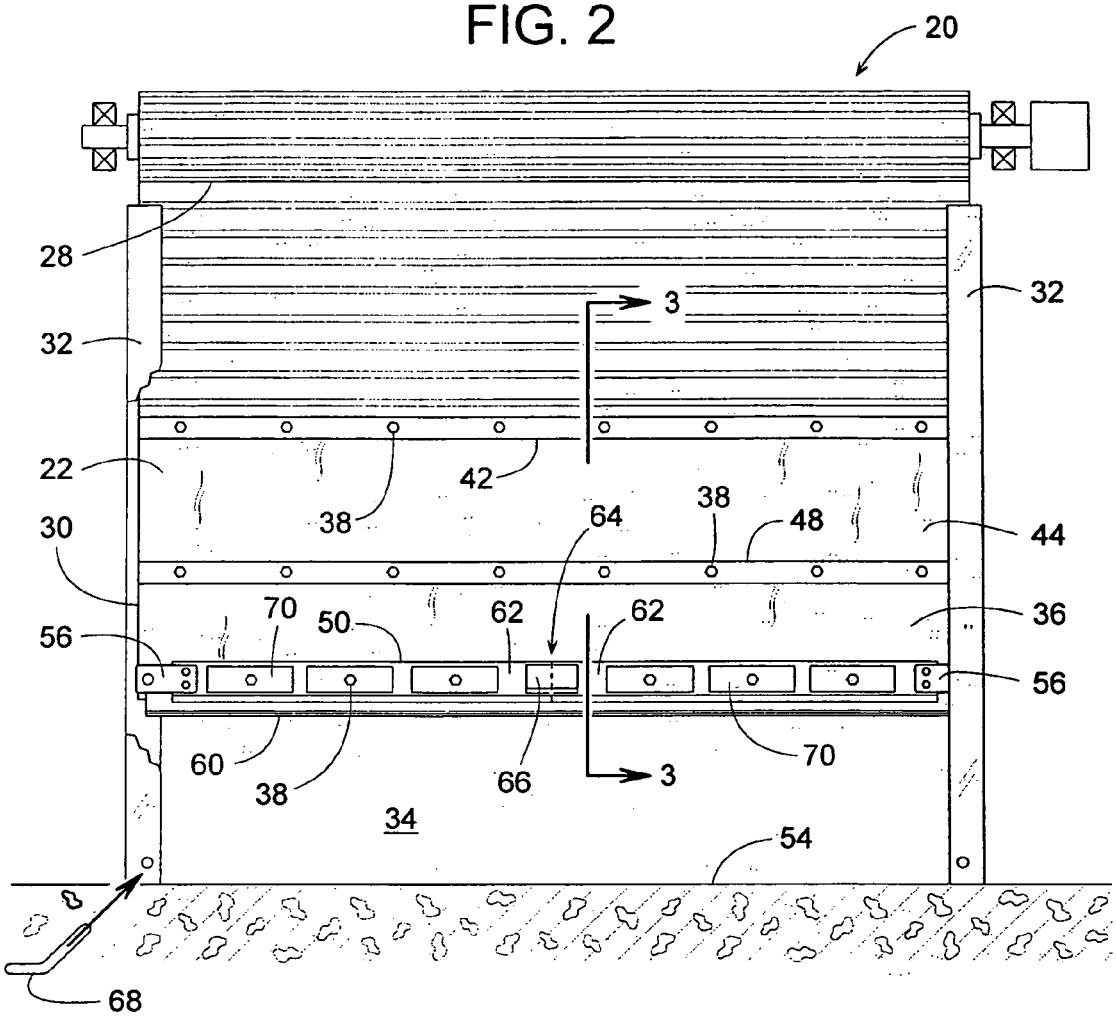
FIG. 2 is a front view similar to FIG. 1 but showing the impactable panel assembly having already been installed.

FIG. 1 shows a metal roll-up door 10 whose lower damaged curtain section 12 is being replaced by a more impactable fabric panel assembly 14 to avoid repeated damage and the resulting repair and/or replacement of that lower section. Fabric panel 14 is attached to the remaining undamaged section 16 of the door's metal roll-up curtain 18. The resulting roll-up door 20 with a combination metal/fabric curtain 22 of FIG. 2 can be the result of retrofitting an existing all-metal roll-up curtain with impactable panel assembly 14 (as shown in FIG. 1), or roll-up door 20 can be originally manufactured that way prior to any damage or partial curtain replacement.

Figure 3:
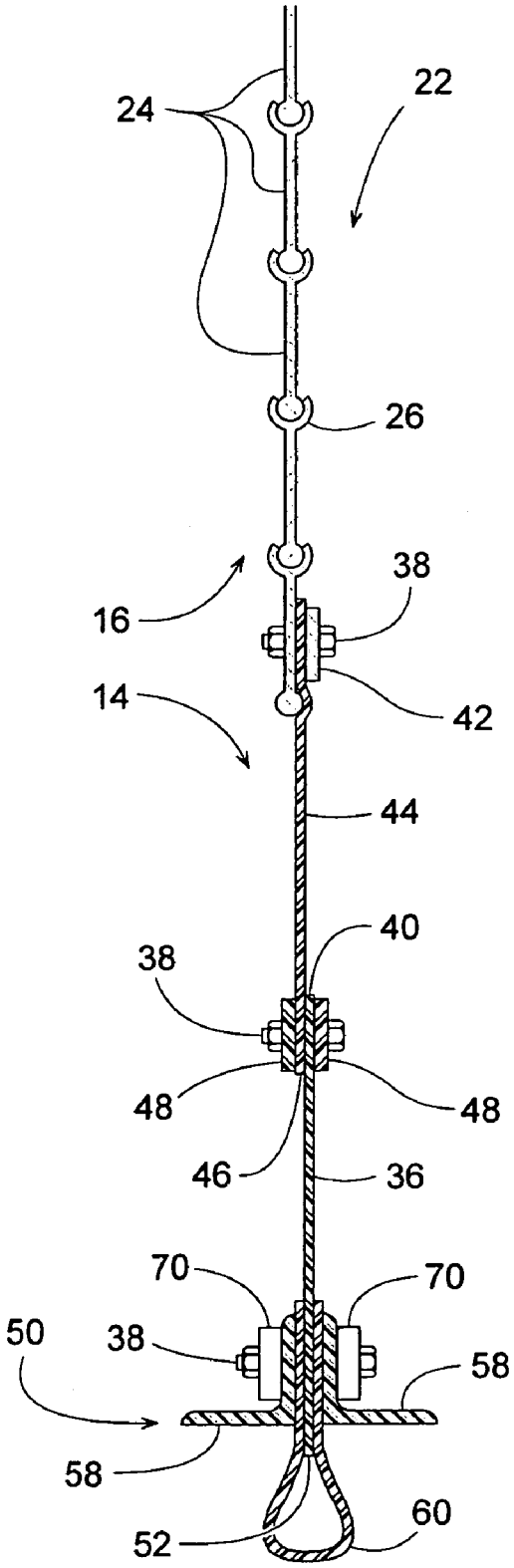
FIG. 3 is a cross-sectional view taken along line 3—3 of FIG. 2.

Referring further to FIG. 3, upper section 16 is a conventional metal roll-up curtain comprising a series of pivotally interconnected metal slats 24. Pivotal connections 26 between the slats enable the metal roll-up curtain to wrap around a roller 28, which rotates to take up or pay out the curtain to respectively open or close the door. Side edges 30 of the curtain are contained within a pair of guide members 32 that help guide the vertical movement of the curtain across a doorway 34.

Figure 4:
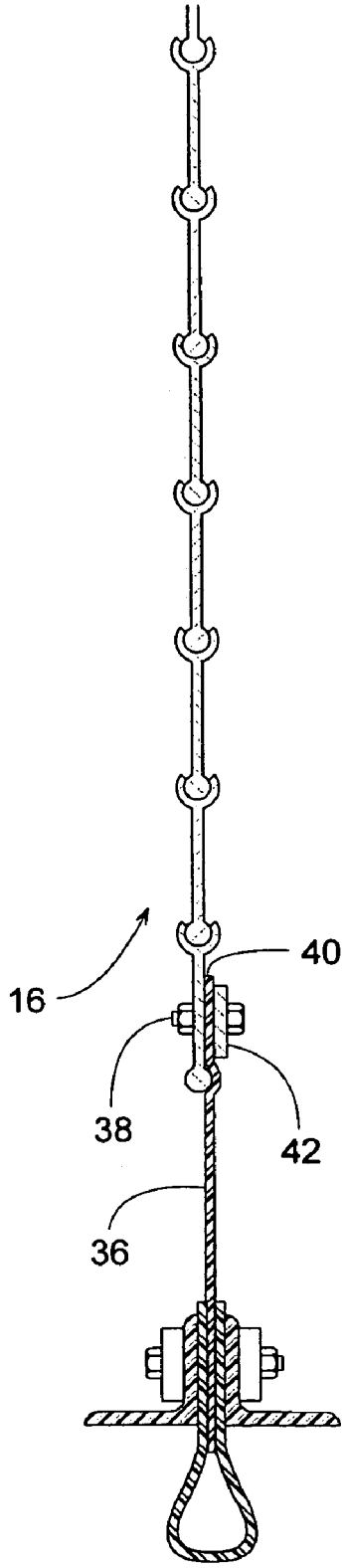
FIG. 4 is a cross-sectional view similar to FIG. 3 but showing a single-curtain impactable panel assembly rather than a multi-curtain one.

Below upper section 16 is impactable panel assembly 14, which comprises at least a first flexible curtain 36. Curtain 36 can be of any suitably pliable material. Examples of curtain materials include; but are not limited to, 2-ply nylon, coated nylon fabric, HYPALON, canvas duck, rubber impregnated fabric, etc. In cases where only a single curtain 36 is added to upper section 16, as shown in FIG. 4, conventional fasteners 38 (e.g., screw, nut & bolt, rivet, hook, clamp, etc.) fasten a first upper edge 40 of curtain 36 to upper section 16. In some cases, fasteners 38 clamp curtain 36 between a metal connecting bar 42 and one of the lower slats of upper section 16. Side edges 30 of curtain 22 preferably extend into guide members 32.

In cases where the doorway's vertical space beneath upper section 16 is greater than that which can be covered by a single sheet of fabric curtain, a second curtain 44 can be attached to first curtain 36 (compare FIGS. 3 and 4). The two curtains can be connected in any manner. Fasteners 38, for example, can connect first upper edge 40 of first curtain 36 to a second lower edge 46 of second curtain 44. To prevent rain from seeping into the joint, curtains 36 and 44 preferably overlap where they join with first upper edge 40 facing indoors and second lower edge 46 facing outdoors.

In applications where the roll-up door is subject to air pressure differentials across opposite faces of the door, one or more windbars 48 can be conveniently installed where curtains 36 and 44 join. The same style of fasteners 38 used for joining curtains 36 and 44 can also be used for attaching windbars 48. The ends of windbars 48 preferably extend into the confines of guide members 32. Windbar 48 can be made of ABS or some other semi-rigid material so that, under impact, windbar 48 is sufficiently flexible to resiliently bend out from within the confines of guide members 32 yet is stiffer than that of curtains 36 and 44.

Some advantages can be gained by installing a semi-rigid bottom bar 50 at a first lower edge 52 of curtain 36. The weight of bottom bar 50 urges the lower portion of curtain 36 flat down against a floor 54 when the door is closed, and the bar's relative rigidity helps keep the lower edge of curtain 36 generally straight. To help guide the vertical movement of curtain 22, the ends of bar 50, or UHMW guide tabs 56 extending therefrom, preferable extend into guide members 32. Bottom bar 50 can be made of ABS or some other semi-rigid material that, under impact, is sufficiently flexible to resiliently bend out from within the confines of guide members 32 yet is stiffer than curtains 36 and 44. In addition, the bottom bar's flexibility allows it to be reinserted into the track following such a breakaway condition—typically without the need for any repair or replacement parts.

The actual construction of bottom bar 50 can vary. In some cases, bottom bar 50 comprises two elongate bar members 58 that are installed side-by-side with lower edge 52 of curtain 36 being clamped therebetween. Conventional fasteners 38 can hold the bottom bar assembly together.

For greater sealing between floor 54 and the lower edge of curtain 22, a seal 60 can be sandwiched between bar members 58 such that a portion of seal 60 extends below bottom bar 50. When the door is closed, seal 60 can help fill a gap that might otherwise exist between bottom bar 50 and floor 54.

In cases where doorway 34 is especially wide, bottom bar 50 may comprise two elongate bar members 62 (FIG. 2) that are connected end-to-end to create one longer bar member 58 with a fixed joint 64. For greater strength, joint 64 can be reinforced by a connector piece 66 that can be glued, welded, screwed, riveted or otherwise fastened to bar members 62. Joint 64 preferably has sufficient strength to withstand an impact that forces bottom bar 50 out from within guide members 32 without significant damage to bar 50 or joint 64, whereby bar 50 is readily returned to normal operation after the impact.

For greater building security, curtain 22 can be locked at its closed position by inserting a pin 68 through coaxially aligned holes in guide member 32 and guide tab 56 of bottom bar 50.

In some cases, replacing a section of metal curtain with a lighter fabric curtain can significantly reduce the overall weight of the resulting combination metal/fabric curtain. To compensate for the door's original counterweight spring or some other type of counterweight system that had been set to counter the door's original weight, one or more deadweights can be attached to the new curtain. The deadweights, for example, can be a series of metal bars 70 that are bolted or otherwise attached to bottom bar 50. Metal bars 70 are preferably spaced apart from each other so as not to excessively reduce the flexibility of bottom bar 50.

Figure 5:
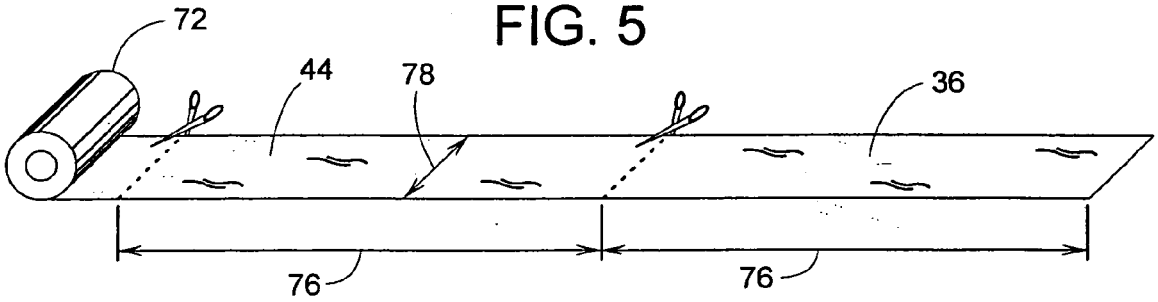
FIG. 5 is perspective view of showing fabric strips being cut to length from a roll of fabric.

A significant benefit of impactable panel assembly 14 is its ability to be readily manufactured as a custom made, retrofit product. Panel assembly 14 is so readily scalable, both horizontally and vertically, that much of it can be manufactured and field assembled right at the jobsite. Referring to FIG. 5, a roll 72 of curtain material having an 18-inch width 78, for example, can be stocked on a service truck that visits various installation sites. At the jobsite, the damaged section of a metal roll-up door can be removed in 18-inch high sections until the entire damaged portion is removed. New fabric curtains 36 and 44 can be unrolled to any curtain length 76 that corresponds or is appropriate for the width of the original metal curtain. Multiple strips of that length can be cut until there are enough fabric strips to replace what was removed from the door.

Windbars 48, connecting bars 42, and bottom bars 50 can also be cut to whatever length is appropriate for the door. Shorter bar segments can be permanently joined end-to-end to create longer bars. And seal 60 can be unrolled and cut to length in a manner similar to producing fabric curtain strips from roll 72. By stocking just a few basic supplies, an infinite selection of part sizes can be produced, whereby the inventory is so low that the materials can be stored on the service truck itself Although the invention is described with reference to preferred embodiments, it should be appreciated by those of ordinary skill in the art that various modifications are well within the scope of the invention. Therefore, the scope of the invention is to be determined by reference to the following claims:

The invention claimed is:

1. A method of repairing a metal rollup door comprising:

removing a damaged door section from a lower section of the metal rollup door;

unrolling a first flexible curtain in a lengthwise direction to expose a curtain length that corresponds to a horizontal width of the metal rollup door;

cutting the first flexible curtain at the curtain length;

unrolling a second flexible curtain in the lengthwise direction;

cutting the second flexible curtain substantially at the curtain length;

coupling the second flexible curtain to the lower section of the metal rollup door; and coupling the first flexible curtain to the second flexible curtain to create a joint that extends across the horizontal width of the metal rollup door.

2. The method of claim 1, wherein the first flexible curtain overlaps the second flexible curtain at the joint.

3. The method of claim 1, further comprising clamping the first flexible curtain between two bar members, wherein the two bar members create a bottom member at a first lower edge of the first flexible curtain.

4. The method of claim 1, further comprising:

joining two ends of two shorter bar members to create one longer bottom bar;

attaching the one longer bottom bar to the first flexible curtain; and holding the two ends of the two shorter bar members substantially stationary relative to each other even as the one longer bottom bar is forced beyond its normal path of travel.

5. The method of claim 1, further comprising:

attaching a bottom bar to the first flexible curtain; and applying tension to the first flexible curtain by adding deadweight to the bottom bar.

* * * * *